US010775138B1

(12) United States Patent
Esquilin-Mangual et al.

(10) Patent No.: US 10,775,138 B1
(45) Date of Patent: Sep. 15, 2020

(54) READY ARMOR PROTECTION FOR INSTANT DEPLOYMENT

(71) Applicant: United States of America as Represented by The Secretary of The Army, Alexandria, VA (US)

(72) Inventors: Omar Esquilin-Mangual, Vicksburg, MS (US); Catherine S Stephens, Clinton, MS (US); Omar G Flores, Vicksburg, MS (US); Andrew B Edwards, Toney, AL (US); Erik M Chappell, Vicksburg, MS (US); Carey D Price, Vicksburg, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 16/296,149

(22) Filed: Mar. 7, 2019

(51) Int. Cl.

| | |
|---|---|
| ***E04B 1/00*** | (2006.01) |
| ***F41H 5/013*** | (2006.01) |
| ***E04B 1/344*** | (2006.01) |
| ***E04B 1/343*** | (2006.01) |
| ***E04H 9/04*** | (2006.01) |

(52) U.S. Cl.
CPC ..... *F41H 5/013* (2013.01); *E04B 1/3445* (2013.01); *E04B 1/34357* (2013.01); *E04H 9/04* (2013.01)

(58) Field of Classification Search
CPC ..... E04B 1/34384; E04B 1/344; E04B 2001/34394; E04B 1/34331; E04B 1/34357; E04B 1/34807; E04B 1/3445; E04B 1/34321; E04B 1/342; B65D 90/00; B65D 88/524; B65D 88/522; B65D 88/52; B65D 90/22; F41H 5/013; E04H 9/04
USPC ..... 52/68, 69, 70, 745.14, 79.5, 79.9, 71; 446/478
See application file for complete search history.

(56) References Cited

U.S. PATENT DOCUMENTS

| | | | | |
|---|---|---|---|---|
| 4,016,686 A * | 4/1977 | Hartger | E04H 6/005 | 52/65 |
| 4,633,626 A * | 1/1987 | Freeman | E04B 1/34315 | 52/126.6 |
| 7,647,731 B2 * | 1/2010 | Muir | E04B 1/3445 | 446/478 |
| 7,882,659 B2 * | 2/2011 | Gyory | E04B 1/3444 | 296/182.1 |
| 8,347,560 B2 * | 1/2013 | Gyory | E04B 1/3444 | 52/79.5 |

(Continued)

*Primary Examiner* — Chi Q Nguyen
(74) *Attorney, Agent, or Firm* — Brian C Jones

(57) ABSTRACT

Ready armor modular protective systems that can be rapidly deployed in an urban environment. Exemplary armor systems include multiple space frame units. Adjacent space frame units can be coupled together with vertically adjustable coupling mechanisms. Coupling mechanisms (e.g. slot and pin connecting mechanisms) can facilitate relative displacement between adjacent space frame units when the units are connected. In this way, a wall of connected adjacent space frame units can be placed and/or moved along an uneven or irregular surface (e.g. having bumps or a grade) and the adjacent space frame units can remain in parallel and/or vertical orientation relative to one another. Suspension mechanisms can help to facilitate or enable rapid deployment of a ready armor modular protective system.

20 Claims, 13 Drawing Sheets

(56) References Cited

U.S. PATENT DOCUMENTS

| | | | | |
|---|---|---|---|---|
| 8,701,356 | B2 * | 4/2014 | Forsland | E04B 1/34305 52/66 |
| 8,763,315 | B2 * | 7/2014 | Hartman | E04B 1/3445 52/71 |
| 9,221,599 | B2 * | 12/2015 | Brennan, Jr. | B65D 90/08 |
| 9,517,979 | B2 * | 12/2016 | Bender | B01J 19/2445 |
| 10,279,990 | B2 * | 5/2019 | Ronstadt | B65D 90/0086 |
| 10,379,201 | B2 * | 8/2019 | Villeval | G01S 13/931 |
| 2006/0043060 | A1 * | 3/2006 | Guthrie | G11B 5/3163 216/22 |
| 2016/0138258 | A1 * | 5/2016 | Schaffert | E04B 1/34357 52/79.5 |

* cited by examiner

READY ARMOR PROTECTION FOR INSTANT DEPLOYMENT

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to protective structures and, more particularly but not exclusively, to rapid deployment protective walls that can be used in an urban setting.

Description of the Related Art

This section introduces aspects that may help facilitate a better understanding of the invention. Accordingly, the statements of this section are to be read in this light and are not to be understood as admissions about what is prior art or what is not prior art.

To protect personnel and assets, organizations such as the military use a variety of protective materials ranging from soil cover to expensive, high-performance, lightweight ballistic ceramics. For the military, a need exists for armor protection systems that can be rapidly deployed in an urban environment. Currently known barriers are described in U.S. Pat. No. 8,464,493 issued Jun. 18, 2013 "Transportable Modular Configuration For Holding Panels", and in U.S. patent application Ser. No. 12/920,497 filed Mar. 2, 2009 "Transportable Modular System Permitting Isolation of Assets". The content of each of the above filings is incorporated herein by reference.

Although currently available protection systems provide valuable protection in many instances, still further improvements are desirable. Embodiments of the present invention provide solutions to at least some of these outstanding needs.

SUMMARY

The present invention was developed to address the challenges described in the Background section. Additional research and further development has led to a novel approach to provide improved protective barriers for use in an urban environment.

It is important to protect both material and personnel from catastrophe, especially in cases where the probability of occurrence is greater than the norm. Conventionally, both temporary and permanent means may be used for this purpose, depending on the scenario. For example, a permanent military facility may best be protected by a permanent configuration, whereas a mobile field unit would best be served by a temporary, but not necessarily less effective, configuration. Conventionally, protection against manmade catastrophe, such as occurs in war zones, has been provided with large bulky concrete structures or earthen embankments that require heavy equipment to produce, whether temporary or permanent. Common needs for protective structure may include barriers to prevent personnel access, vehicular intrusion, or even line-of-site access, as well as protective enclosures for emergency response personnel or revetments for high value assets. Select embodiments of the present invention provide good protection for both personnel and valued assets and are of value for the protection of military, industrial, community and personal assets. Embodiments of the present invention also can be implemented quickly and efficiently in an urban environment.

The structures and methods for Modular Protective System-Ready Armor Protection For Instant Deployment (MPS-RAPID) disclosed herein provide improved levels of protection over that which is provided by many known protective structures from small arms, fragmenting rounds, improvised explosives, and blast threats.

An MPS-RAPID system provides an early entry system for instant protection, and can support personnel operating in dense urban environments in site exploitation and hasty defense. MPS-RAPID systems can be deployed and tailored to create road blocks/checkpoints, support cordon and counter-mobility operations, creating buffer zones, providing blast and ballistic protection (e.g. for urban blocks), managing pedestrian traffic, and establishing concealment and perimeter security. In some cases, MPS-RAPID systems can include space frame units having wheels, so as to facilitate ease of setup and takedown. In some cases, MPS-RAPID systems can be deployed in a matter of minutes. Exemplary MPS-RAPID systems are scalable and/or recoverable.

BRIEF DESCRIPTION OF THE DRAWINGS

Embodiments of the invention will become more fully apparent from the following detailed description, the appended claims, and the accompanying drawings in which like reference numerals identify similar or identical elements.

FIGS. 1A, 1B, and 10 depict aspects of an exemplary Modular Protective System-Ready Armor Protection for Instant Deployment (MPS-RAPID) system, according to certain embodiments of the invention;

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Embodiments of the present invention encompass Modular Protective System-Ready Armor Protection for Instant Deployment (MPS-RAPID) systems, and methods for their use and manufacture. MPS-RAPID is a quickly deployable wall system designed to provide blast and ballistic protection, to prevent intrusion, and to serve as Line-of-Sight Denial in an urban setting. MPS-RAPID systems are scalable and recoverable and can be tailored to meet specified threats. MPS-RAPID systems can be delivered in Quadcons and on palletized loading system (PLS) trucks. In some cases, up to 130 linear feet of early protection wall are provided per PLS truck. MPS-RAPID systems can be used as Entry Control Point (ECP) boundaries and/or perimeters. MPS-RAPID systems are well suited for use in urban environments, and can be deployed on paved roads. In some cases, MPS-RAPID systems can be deployed on a typical 20' ISO, Quadcons or Tricons over PLS Truck (containers removed). In some cases, MPS-RAPID systems can be deployed on a road having a maximum road slope of 10% longitudinal and 5% transversal. In some cases, MPS-RAPID systems can be deployed on a road having a maximum slope change of 10%.

Figure 1A:
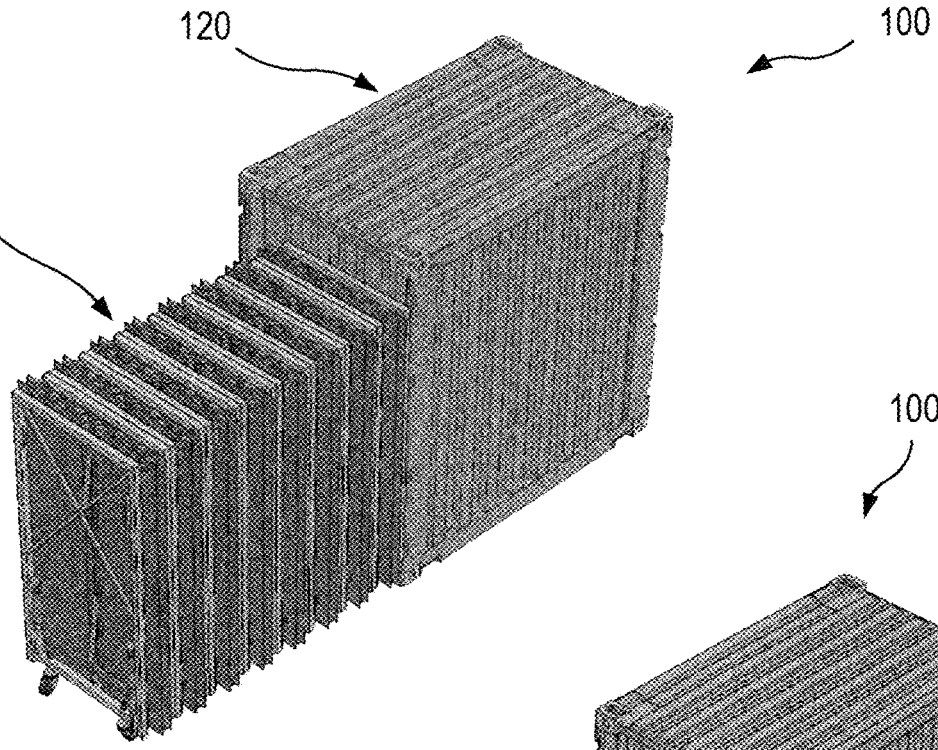
Figure 1B:
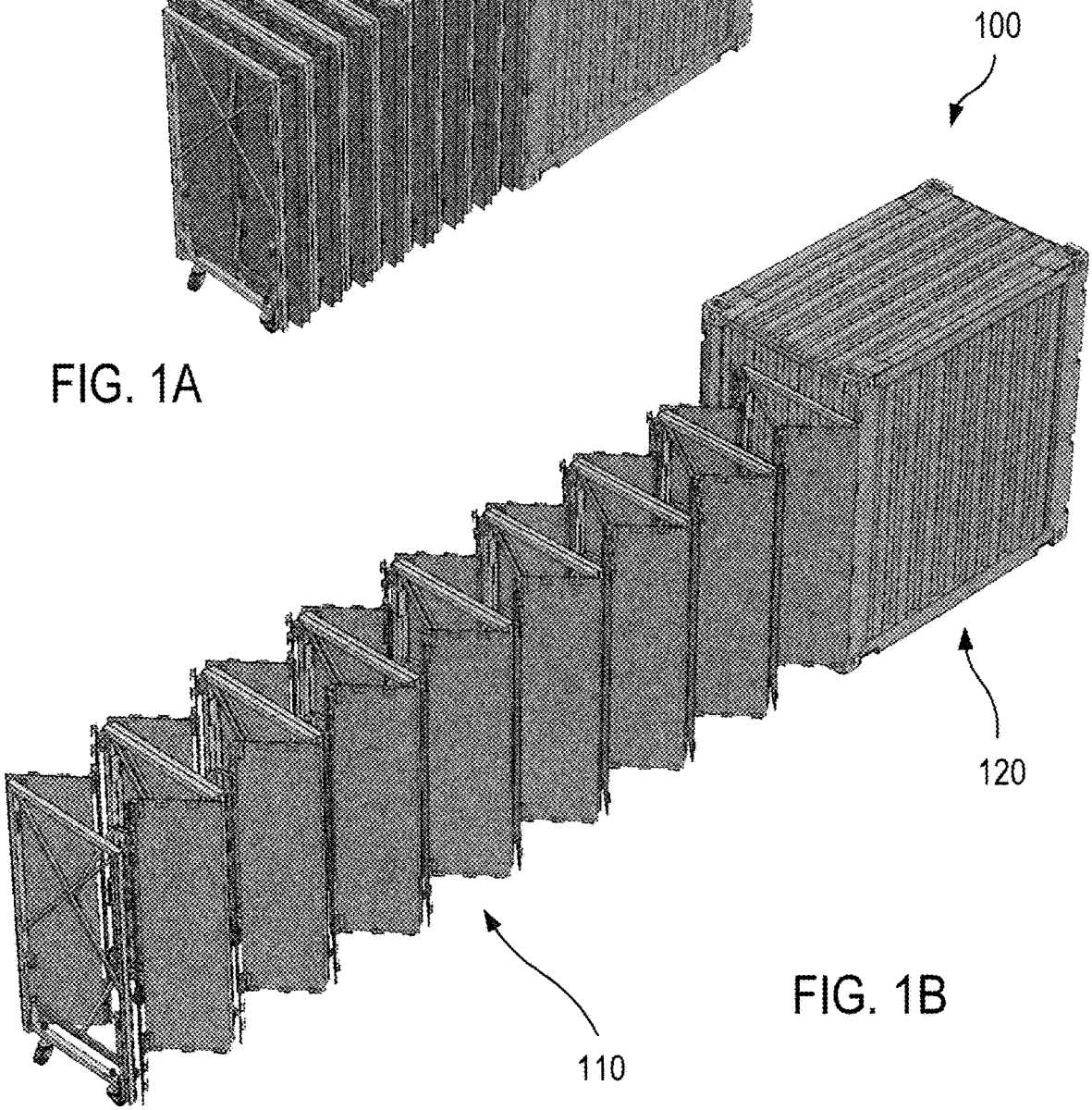
Figure 1C:
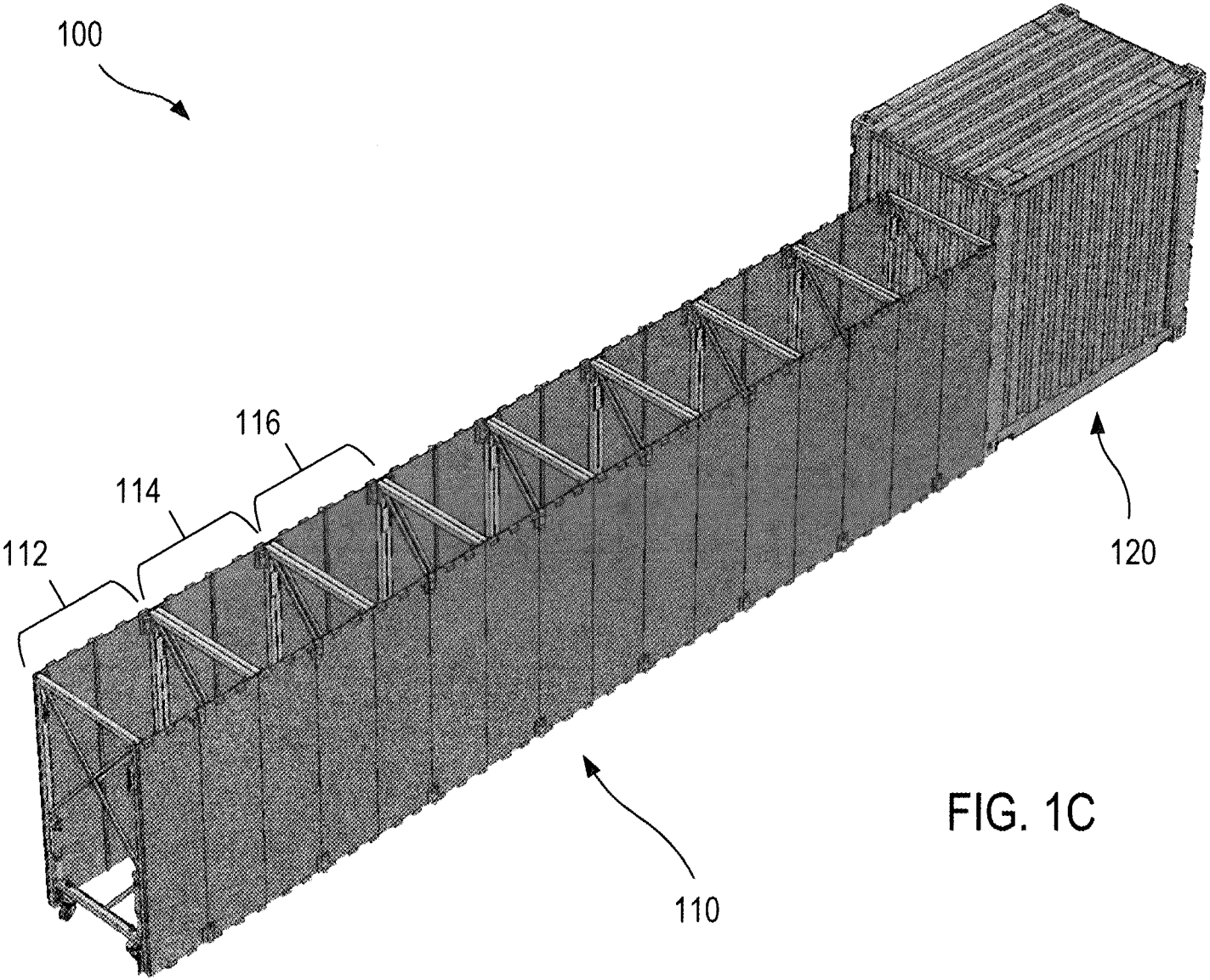

Turning now to the drawings, FIG. 1A depicts aspects of an exemplary armor system 100 according to embodiments of the present invention. As depicted here, armor system 100 includes a wall assembly 110 and a container 120. Wall assembly 110 is in a closed configuration. FIG. 1B depicts aspects of the exemplary armor system 100 according to embodiments of the present invention. As depicted here, wall assembly 110 is in a partially open configuration. FIG. 1C depicts aspects of the exemplary armor system 100 according to embodiments of the present invention. As depicted here, wall assembly 110 is in an open configuration. Wall assembly 110 includes multiple collapsible space frame units (e.g. 112, 114, 116, and so on). The frame units are in an open, unfolded, or uncollapsed configuration in FIG. 1C, and are in a closed, folded, or collapsed configuration in FIG. 1A. To facilitate ease of setup and/or takedown, MPS-RAPID systems can include or be used with a winch mechanism, whereby space units are extended and/or retracted by operation of the winch, optionally in combination with a cable (e.g. ¼ inch cable) that is in operative association with the space units. As seed in these figures, the wall assembly has an internal frame system that operates in a manner similar to an accordion, and the wall assembly includes armor panels or plates engaged with the internal frame system.

In some embodiments, container 120 can be an ISO 20' container, having a tare/payload of 4,740/62,460 lbs. In some embodiments, container 120 can be a QUADCON Type II container, having a tare/payload of 2,120/9,040 lbs. An armor kit may include multiple Quadcon containers. For example, a basic armor configuration kit may include 4 Quadcon containers, with 7 space frame units per Quadcon container. A full armor configuration kit may include 3 Quadcon containers, with 6 space frame units per Quadcon container, plus an additional Quadcon container that includes 144 armor panels. An armor kit can provide various protective wall lengths. For example, with a Palletized Load System (PLS) truck having a Type II Quadcon capacity, a basic armor configuration kit can provide 130' of protective wall length, and a full armor configuration can provide 95' of protective wall length. Table 1 provides exemplary space, weight, and PLS truck limitations according to embodiments of the present invention. In some cases, a PLS truck lifting capacity can be 16.5 ton.

TABLE 1

| Limitation | Typical Quadcon | Typical 20' ISO Container |
|---|---|---|
| Space | 8 Units w/E-Glass = 28' | 40 Units w/E-Glass = 140' |
| Weight | 6 Units w/E-Glass = 21' | 40 Units w/E-Glass = 140' |
| PLS Truck | 4 Units/Quadcon w/E-Glass = 14' (63'/Truck) | 21 Units w/E-Glass = 73.5' |
| PLS Truck | 7 Units/Quadcon No E-Glass = 24.5' (98'/Truck) | 33 Units No E-Glass = 115.5' |

In some case, a wall assembly composed of multiple frame units can be pre-manufactured or pre-assembled, placed inside of a Quadcon, Tricon or ISO container, transported to an installation site, and then pulled or removed from the Quadcon, Tricon or ISO container at the desired location. In some cases, the Quadcon, Tricon or ISO container can be attached to the wall assembly, so that the Quadcon, Tricon or ISO container provides protection as an extension of the wall assembly itself. In some cases, the Quadcon, Tricon or ISO container can include supplemental armor plates or mechanisms for enhanced fortification (e.g. positioned within the interior of the Quadcon, Tricon or ISO container).

Figure 2A:
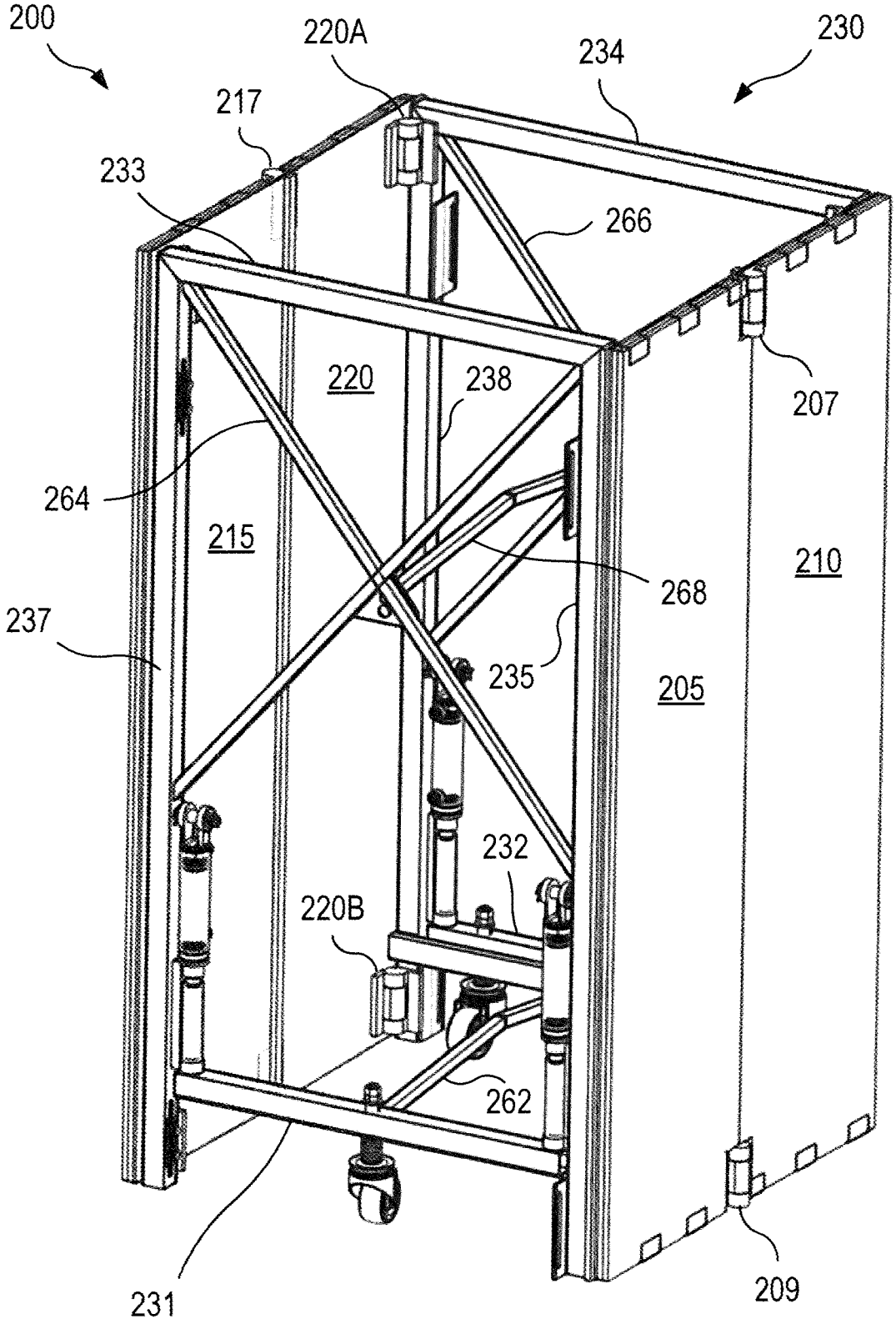
FIGS. 2A to 2K depict aspects of an exemplary Modular Protective System-Ready Armor Protection for Instant Deployment (MPS-RAPID) system, according to certain embodiments of the invention.

FIG. 2A depicts aspects of an exemplary space frame unit 200 according to embodiments of the present invention. As shown here, frame unit 200 is in the uncollapsed or open configuration. Frame unit 200 includes a first inner wall panel assembly 205, a second inner wall panel assembly 210, a first outer wall panel assembly 215, and a second outer wall panel assembly 220. The panel assemblies are supported by a frame assembly 230 that includes a first lower horizontal frame member 231, a second lower horizontal frame member 232, a first upper horizontal frame member 233, a second upper horizontal frame member 234, a first inner vertical frame member 235, a second inner vertical frame member (not shown), a first outer vertical frame member 237, and a second outer frame member 238. Space frame unit 200 also includes a lower locking bar 262 coupled with first lower horizontal frame member 231 and second lower horizontal frame member 232. Further, space frame unit includes a first cross support 264, a second cross support 266, and an upper locking bar 268 coupled with first cross support 264 and second cross support 266. When a space frame unit is in an open or uncollapsed position, a locking bar can be locked, so as to maintain a fixed distance between horizontal frame members or cross supports of the space frame. When a locking bar is unlocked, the space frame unit can be closed or collapsed, whereby the horizontal frame members can be brought closer together, and whereby the cross supports can be brought closer together.

Figure 2B:
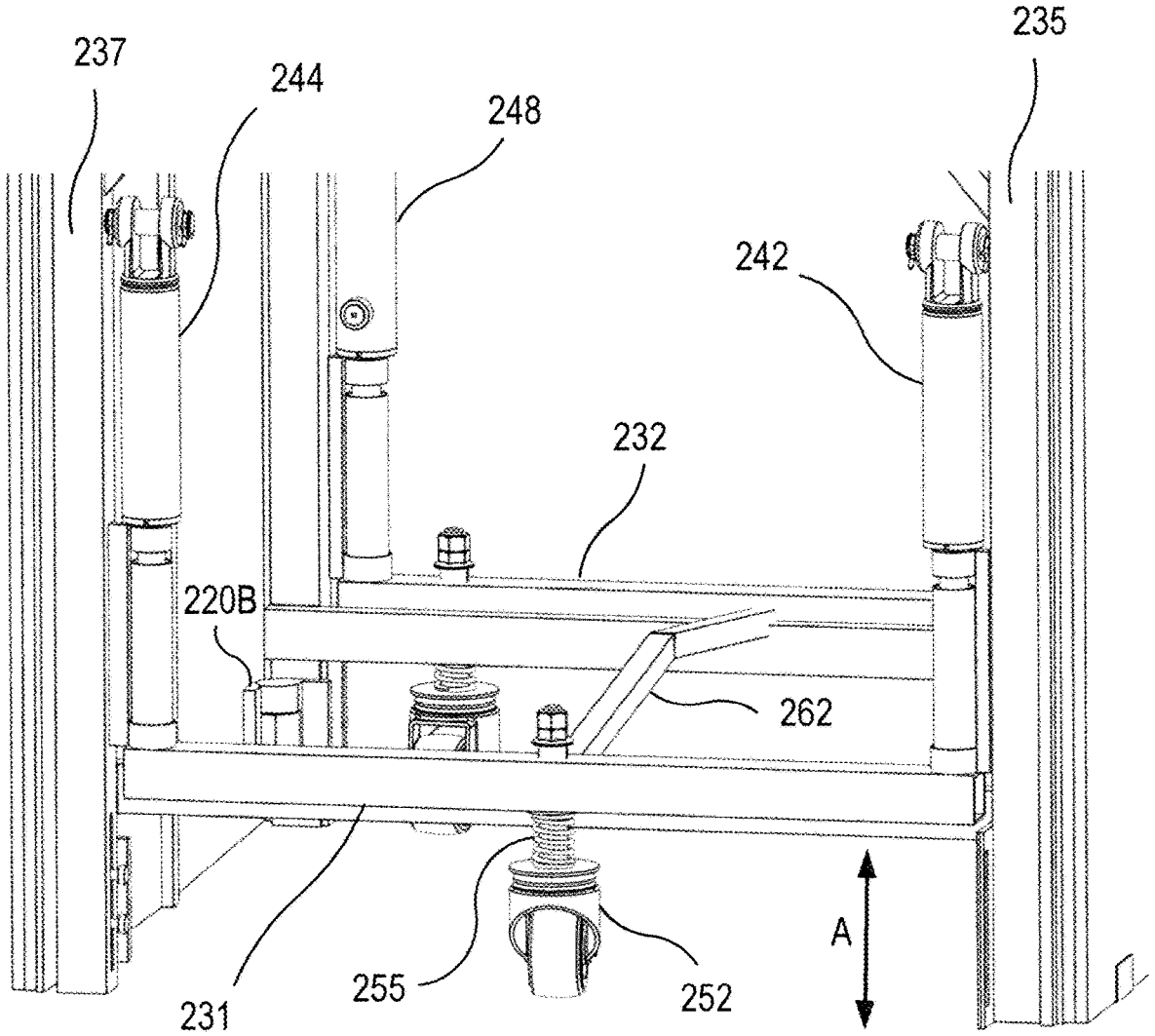
Figure 2C:
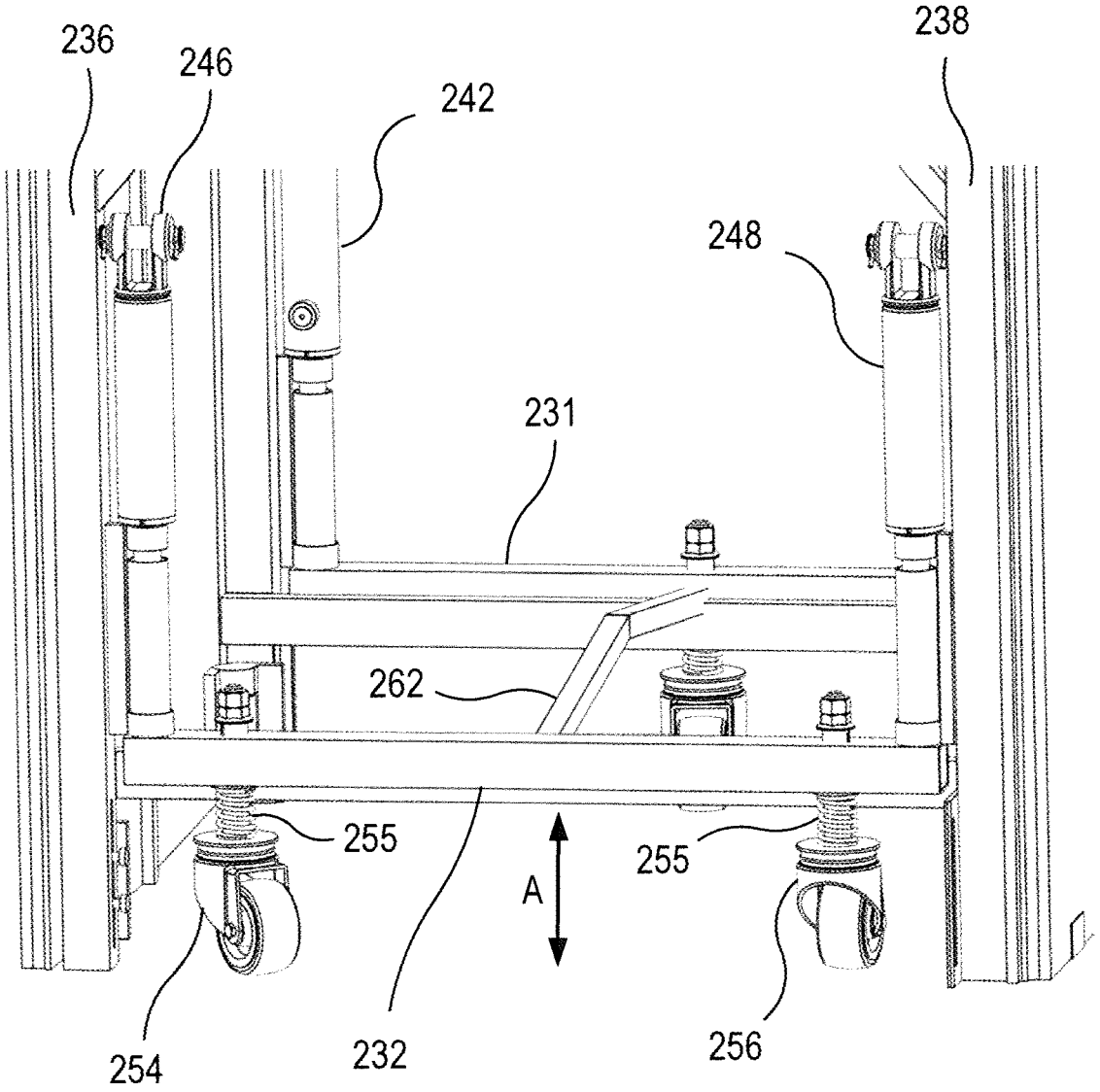

As shown in FIGS. 2B and 2C, first lower horizontal member 231 is coupled with first inner vertical frame member 235 via a first inner suspension mechanism 242, and with first outer vertical frame member 237 via a first outer suspension mechanism 244. In this way, first lower horizontal member 231 can move vertically with respect to the vertical frame members 235 and 237, as indicated by arrow A. In some cases relative distance between 235 and 231 in the direction of arrow A can be 6 inches. A first wheel 252 is coupled with first lower horizontal member 231. Likewise, second lower horizontal member 232 is coupled with second inner vertical frame member 236 via a second inner suspension mechanism 246, and with second outer vertical frame member 238 via a second outer suspension mechanism 248. In this way, second lower horizontal member 232 can move vertically with respect to the vertical frame members 236 and 238, as indicated by arrow A. An second inner wheel 254 and a second outer wheel 256 are coupled with second lower horizontal member 232. In some cases, the suspension mechanisms can be provided as hydraulic cylinders, for example with a 6 inch stroke capacity. In some cases, the wheels may include a shock absorber 255, such as a 1 inch shock absorber. Advantageously, suspension mechanisms as disclosed herein can help to facilitate or enable rapid deployment of a ready armor modular protective system.

Figure 2D:
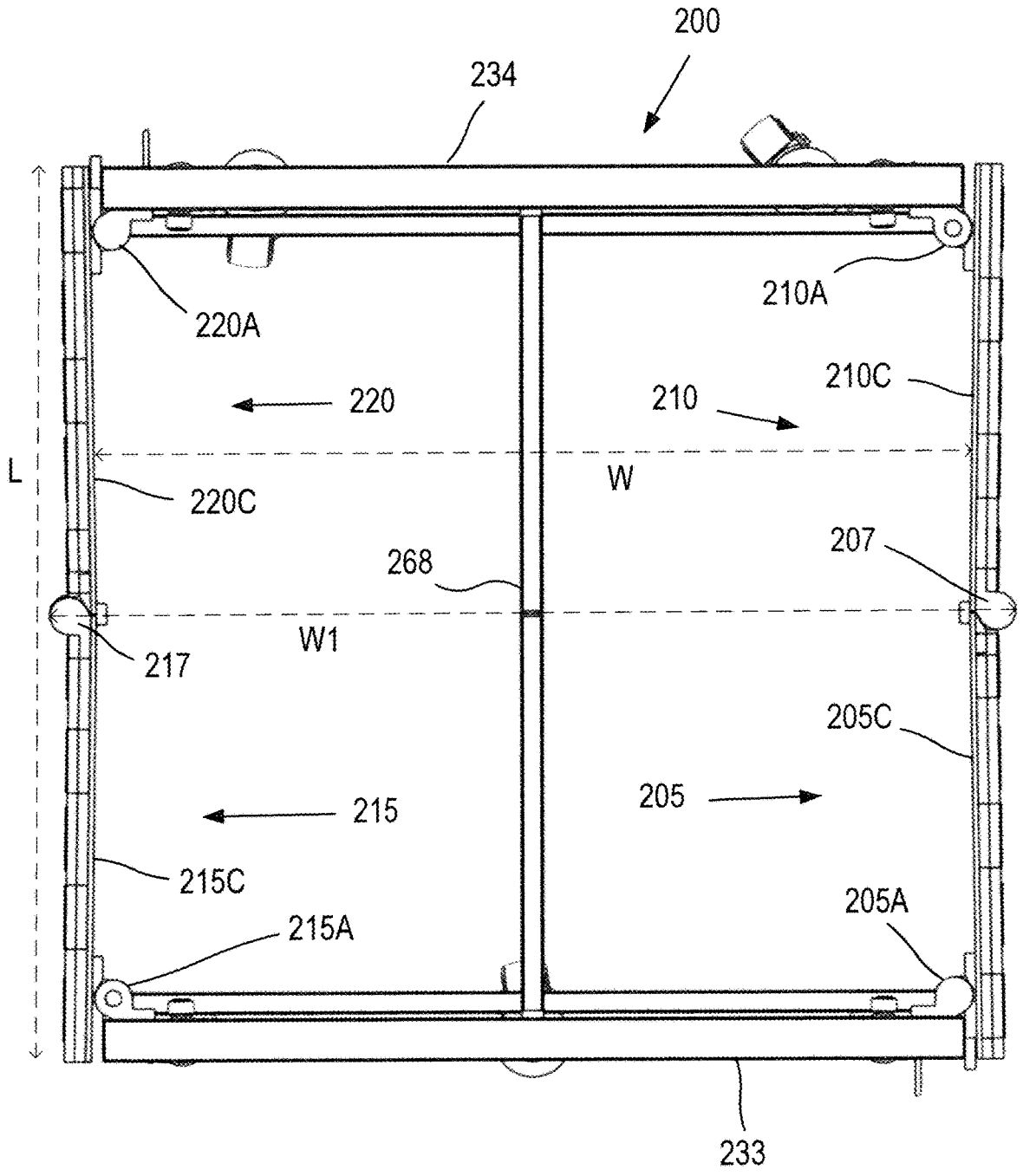
Figure 2E:
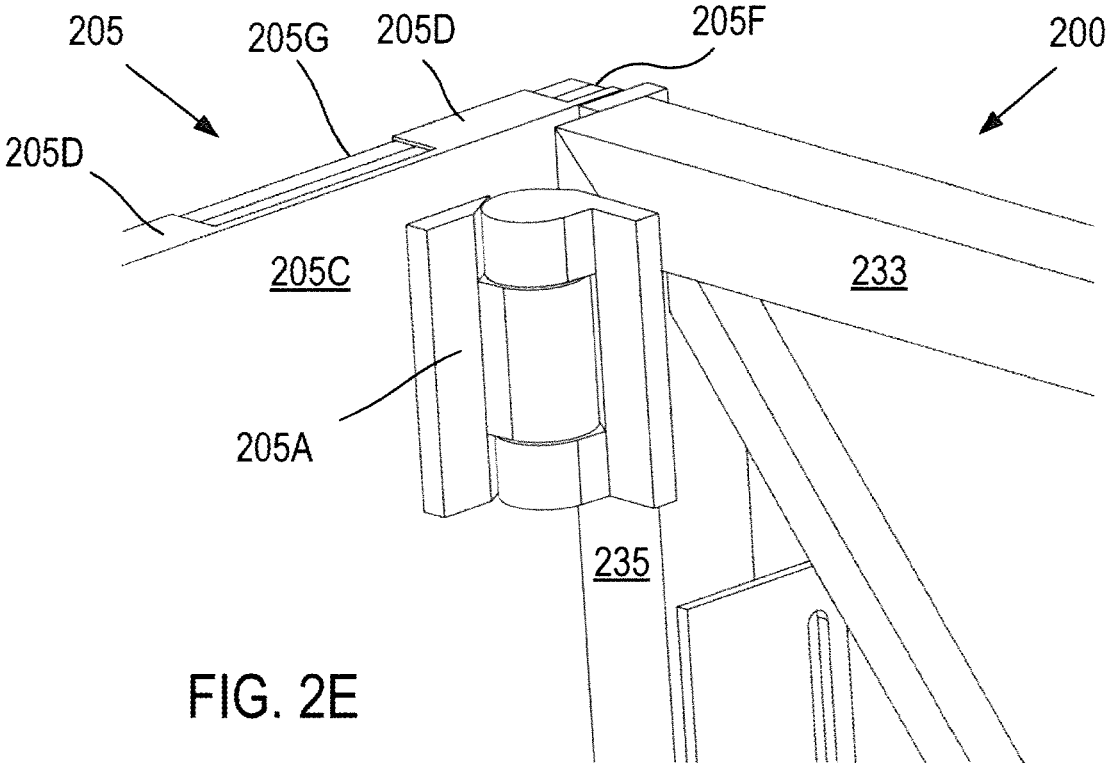
Figure 2F:
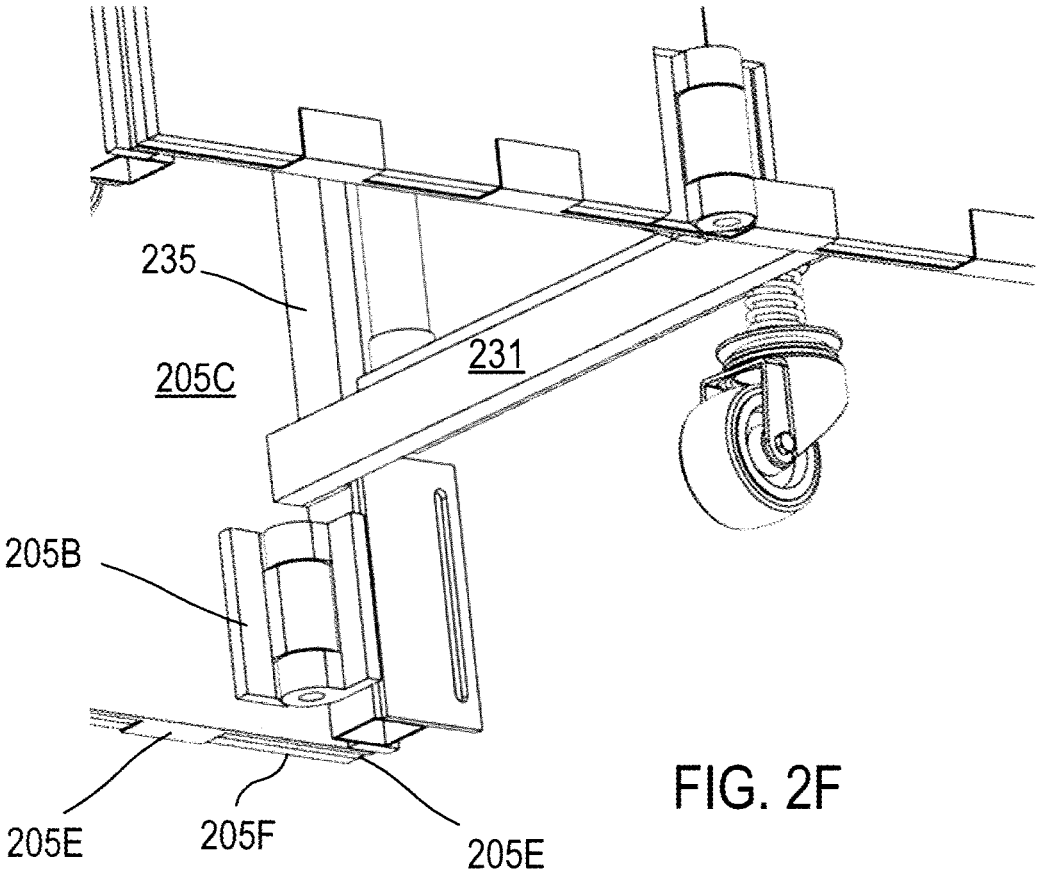

As shown in the top view of FIG. 2D and the perspective views of FIGS. 2E and 2F, first inner wall panel assembly 205 is coupled with frame 200 (e.g. with first upper horizontal frame member 233 and/or first inner vertical frame member 235) via a first upper hinge 205A and a first lower hinge 205B. In some cases, first inner wall panel assembly 205 can include a basic armor plate 205C having upper flanges 205D and lower flanges 205E, whereby flanges 205D and 205E can operate to couple with, support, and/or secure supplementary armor plates 205F (inner supplementary plate) and 205G (outer supplementary plate). In a similar fashion, second inner wall panel assembly 210, first outer wall panel assembly 215, and second outer wall panel assembly 220 can be coupled with frame 200. In some cases, a space frame unit can have a width W of 41 inches (inside gap, panel to panel), a length L of 42 inches, and a height of 78 inches when the wheels are retracted. In some cases, a supplementary armor plate can be constructed of E-Glass. In some cases, a space frame unit can have a width W1 of 46 inches (including central hinges 207 and 217), a length L of 42 inches, and a height of 78 inches when the wheels are retracted. The height may be 84 inches when the wheels are extended. In some embodiments, the space frame unit can roll along the surface of the ground when the wheels are extended (e.g. lower horizontal frame members are extended downward due to operation of the hydraulic cylinders), and the space frame unit can rest in a secure position upon the surface of the ground when the wheels are retracted (e.g. lower horizontal frame members are raised upward due to operation of the hydraulic cylinders). In some cases, the hydraulic cylinders can be attached with a hydraulic unit that is disposed within a Quadcon or ISO container via respective hydraulic lines. In some cases, manual jacks or other lifting/lowering mechanisms can be used to raise and lower the wheels (e.g. by raising and lowering the lower horizontal frame members). In some cases, multiple frame units can be raised and/or lowered simultaneously.

FIG. 2D also illustrates that basic armor plate 205C of first inner wall panel assembly 205 can be coupled with a basic armor plate 210C of second inner wall panel assembly 210 via an upper inner central hinge 207, and that a basic armor plate 215C of first outer wall panel assembly 215 can be coupled with a basic armor plate 220C of second outer wall panel assembly 220 via an upper outer central hinge 217. Second inner wall panel assembly 210 can be coupled with frame 200 (e.g. with second upper horizontal frame member 234 and/or second inner vertical frame member) via a second upper hinge 210A and a second lower hinge (not shown). First outer wall panel assembly 215 can be coupled with frame 200 (e.g. with first upper horizontal frame member 233 and/or first outer vertical frame member) via a first upper hinge 215A and a first lower hinge (not shown). Second outer wall panel assembly 220 can be coupled with frame 200 (e.g. with second upper horizontal frame member 234 and/or second outer vertical frame member) via a second upper hinge 220A and a second lower hinge (not shown).

Figure 2G:
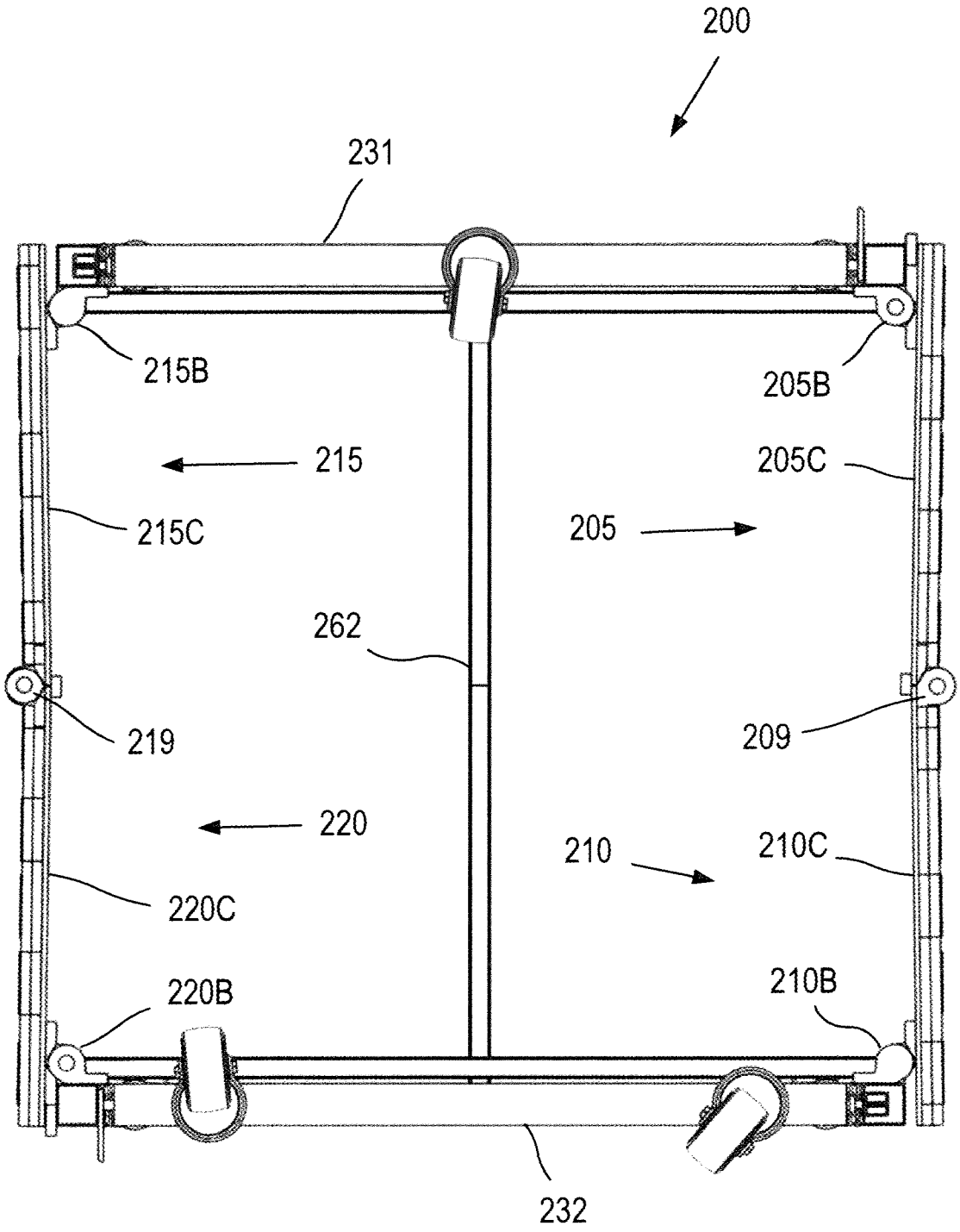

FIG. 2G illustrates that basic armor plate 205C of first inner wall panel assembly 205 can be coupled with a basic armor plate 210C of second inner wall panel assembly 210 via a lower inner hinge 209, and that a basic armor plate 215C of first outer wall panel assembly 215 can be coupled with a basic armor plate 220C of second outer wall panel assembly 220 via an upper outer hinge 219. First inner wall panel assembly 205 can be coupled with frame 200 (e.g. with first lower horizontal frame member 231 and/or first inner vertical frame member) via a first lower hinge 205B. Second inner wall panel assembly 210 can be coupled with frame 200 (e.g. with second lower horizontal frame member 234 and/or second inner vertical frame member) via a second lower hinge 210B and a second upper hinge (not shown). First outer wall panel assembly 215 can be coupled with frame 200 (e.g. with first lower horizontal frame member 231 and/or first outer vertical frame member) via a first upper hinge (not shown) and a first lower hinge 215B. Second outer wall panel assembly 220 can be coupled with frame 200 (e.g. with second lower horizontal frame member 232 and/or second outer vertical frame member) via a second upper hinge (not shown) and a second lower hinge 220B.

Figure 2H:
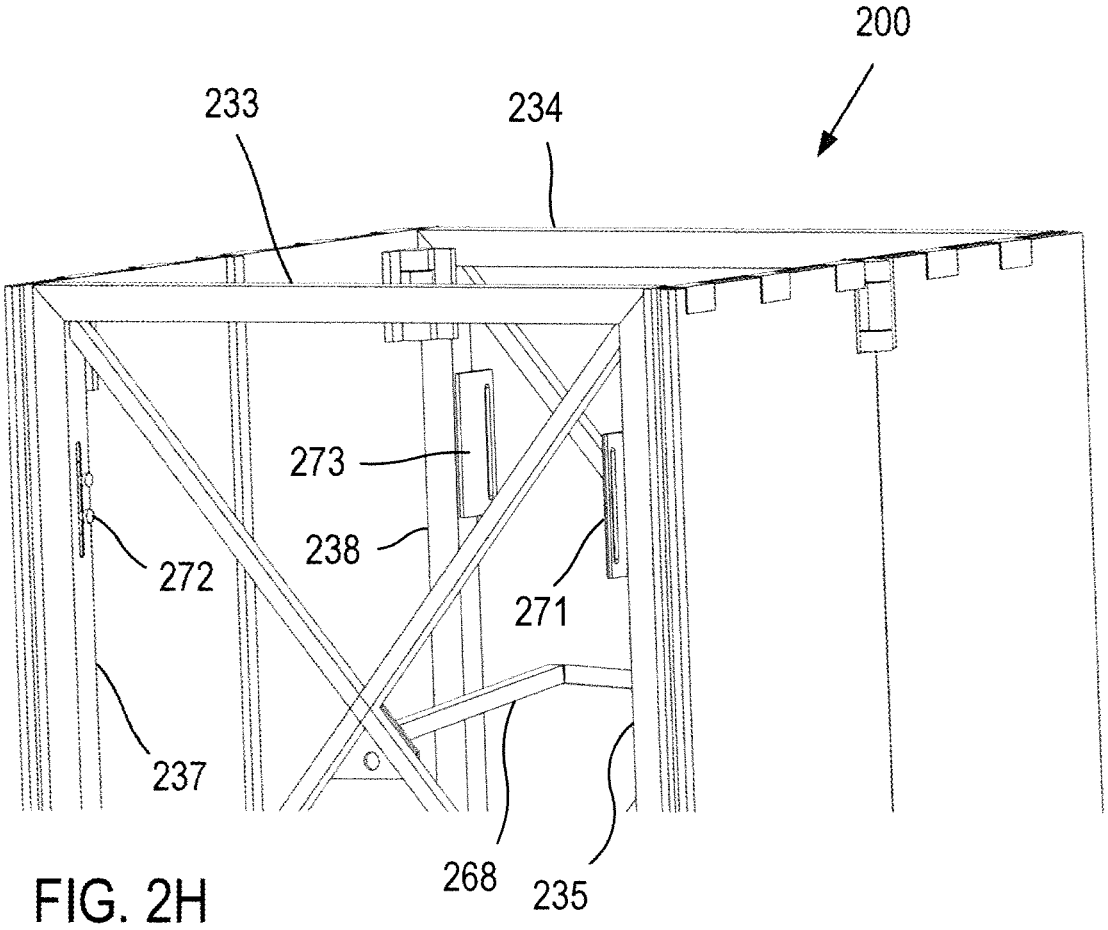

Adjacent space frame units can be coupled via slot and pin connecting mechanisms. For example, as shown in FIG. 2H, space frame unit 200 includes a first inner upper slot mechanism 271, a first outer upper pin mechanism 272, and a second outer upper slot mechanism 273.

Figure 2I:
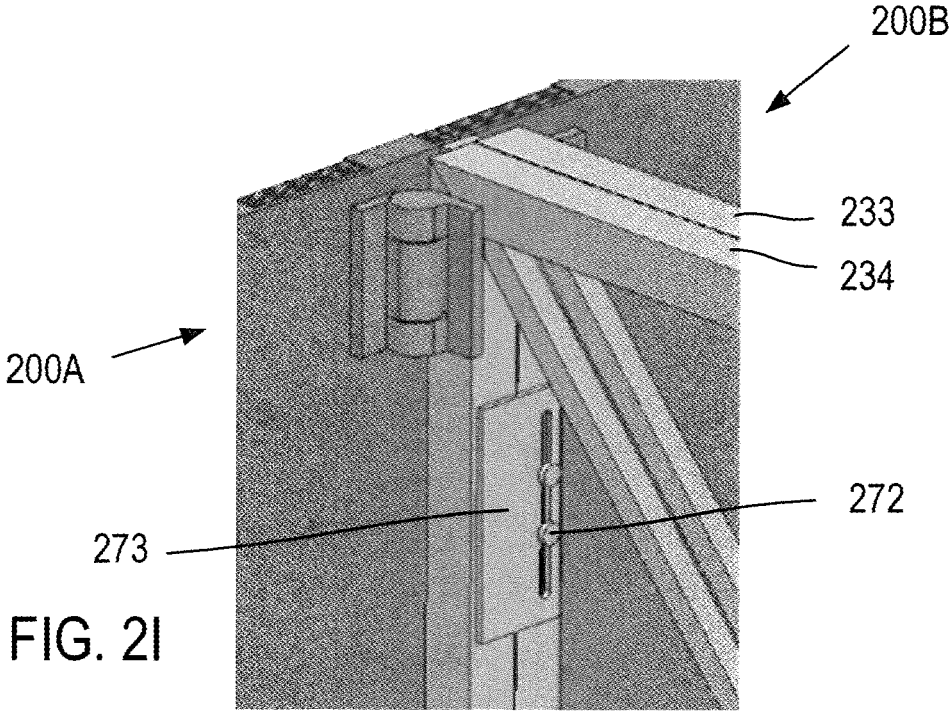

FIG. 2I depicts a coupling between two adjacent space frame units. As shown here, second outer upper slot mechanism 273 of a first space frame unit 200A engages first outer upper pin mechanism 272 of second space frame unit 200B.

Figure 2J:
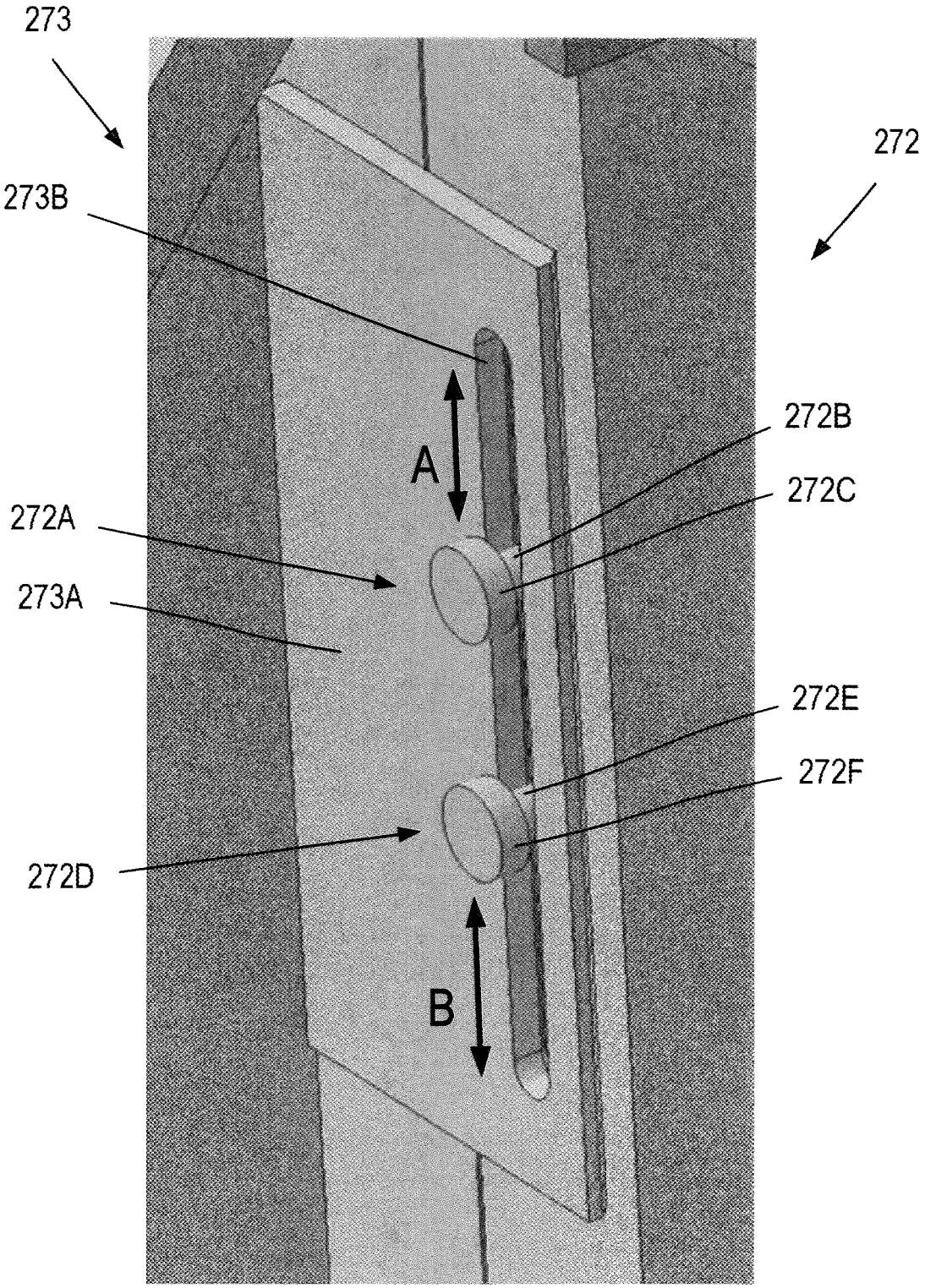

As shown in FIG. 2J, a slot mechanism 273 can include a plate 273A and an elongate aperture 273B in the plate. A pin mechanism 272 can include a first pin 272A having a first stem 272B and a first cap 272C, and a second pin 272D having a second stem 272E and a second cap 272F. In operation, the caps keep the pin mechanism from disengaging from the slot mechanism. The spacing between pins 272A and 272D is less than the length of the elongate aperture 273B, so that adjacent space frame units can move up and down in a vertical direction relative to one another, as indicated by arrows A and B. In this way, a wall of connected adjacent space frame units can be placed and/or moved along an uneven or irregular surface (e.g. having bumps or a grade) and the adjacent space frame units can remain in parallel and/or vertical orientation relative to one another. In this sense, the one or more slot and pin connecting mechanism pairs can be referred to as vertically adjustable coupling mechanisms. As such, the coupling mechanisms (e.g. slot and pin connecting mechanisms) can provide for relative displacement between adjacent space frame units when the units are connected.

Figure 2K:
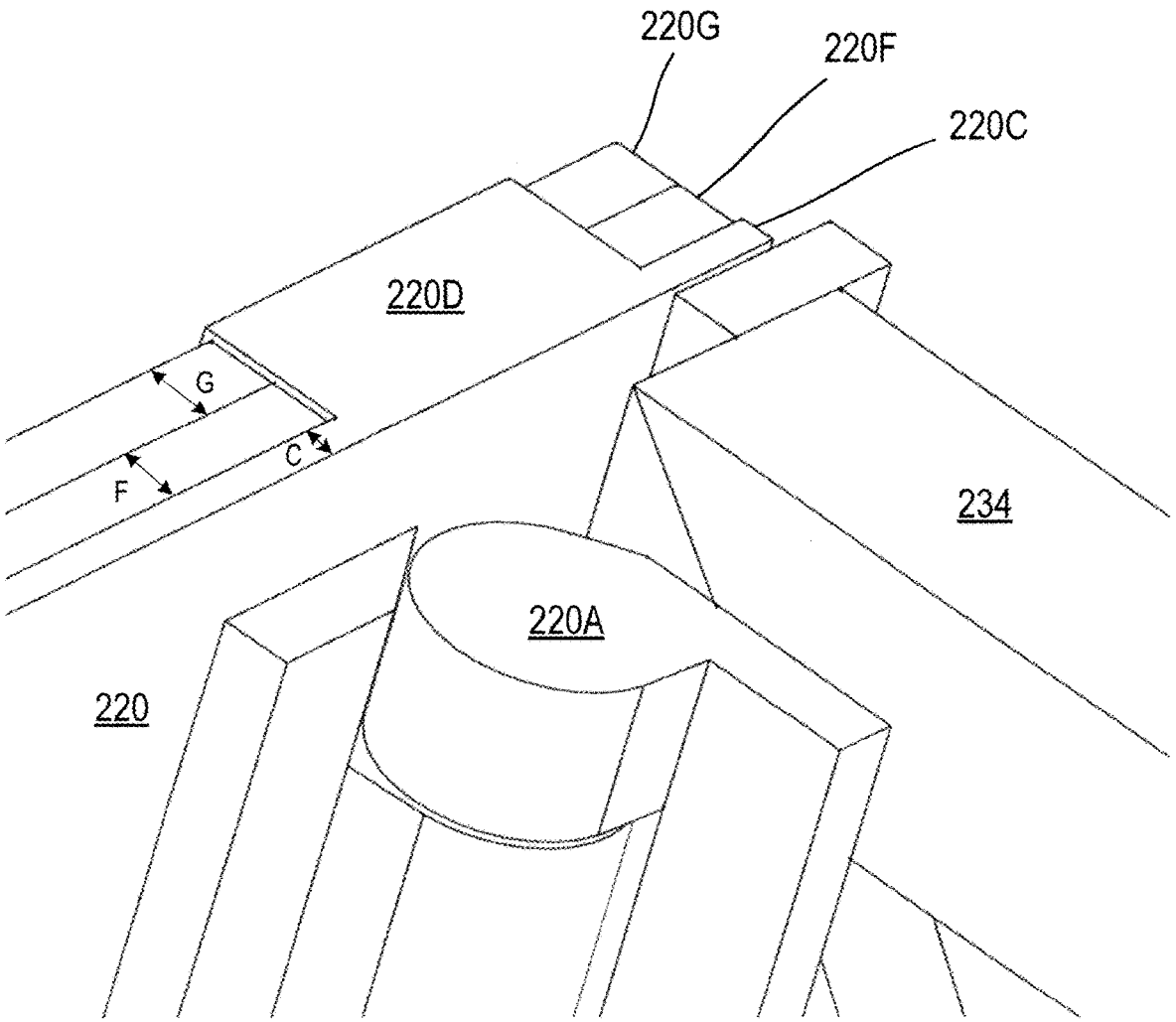

As depicted in FIG. 2K, a wall assembly (e.g. second outer wall panel assembly 220) can have a basic armor plate 220C having upper flanges 220D and lower flanges (not shown), whereby the flanges can operate to couple with, support, and/or secure supplementary armor plates 220F and 220G. Basic armor plate 220C can have a thickness C. In some cases, thickness C can be ¼ inch. In some cases, basic armor plate 220C can be a steel panel. In some cases, basic and/or supplementary armor plates can be made of E-glass or steel. In some cases, supplementary armor plates can be made of concrete.

When considering FIGS. 2D, 2E, and 2K in combination, it can be understood that a first inner wall panel assembly can include a first inner supplementary armor plate and a first outer supplementary armor plate engaged by an upper flange and a lower flange of a basic armor plate of the first inner wall panel assembly, a second inner wall panel assembly can include a second inner supplementary armor plate and a second outer supplementary armor plate engaged by an upper flange and a lower flange of a basic armor plate of the second inner wall panel assembly, a first outer wall panel assembly can include a first inner supplementary armor plate and a first outer supplementary armor plate engaged by an upper flange and a lower flange of a basic armor plate of the first outer wall panel assembly, and a second outer wall panel assembly can include a first inner supplementary armor plate and a first outer supplementary armor plate engaged by an upper flange and a lower flange of a basic armor plate of the second outer wall panel assembly.

In some cases, one or more hinges of a frame (e.g. hinge 220A can be a McMaster Carr Heavy duty hinge. In some cases, a horizontal frame member (e.g. frame member 234) can be HSS square tubing (e.g. 2 SQ×0.075 WALL). Supplementary armor plate 220F can have a thickness F. In some cases, thickness F can be ½ inch. Supplementary armor plate 220G can have a thickness G. In some cases, thickness G can be ½ inch. In some cases, a supplementary armor plate may be an E Glass panel. In some cases, a space frame unit may weigh 850 pounds with a basic armor configuration (e.g. with 4 basic armor plates), and 1,330 pounds with a full armor configuration (e.g. with 4 basic armor plates and 8 supplemental armor plates).

Figure 3A:
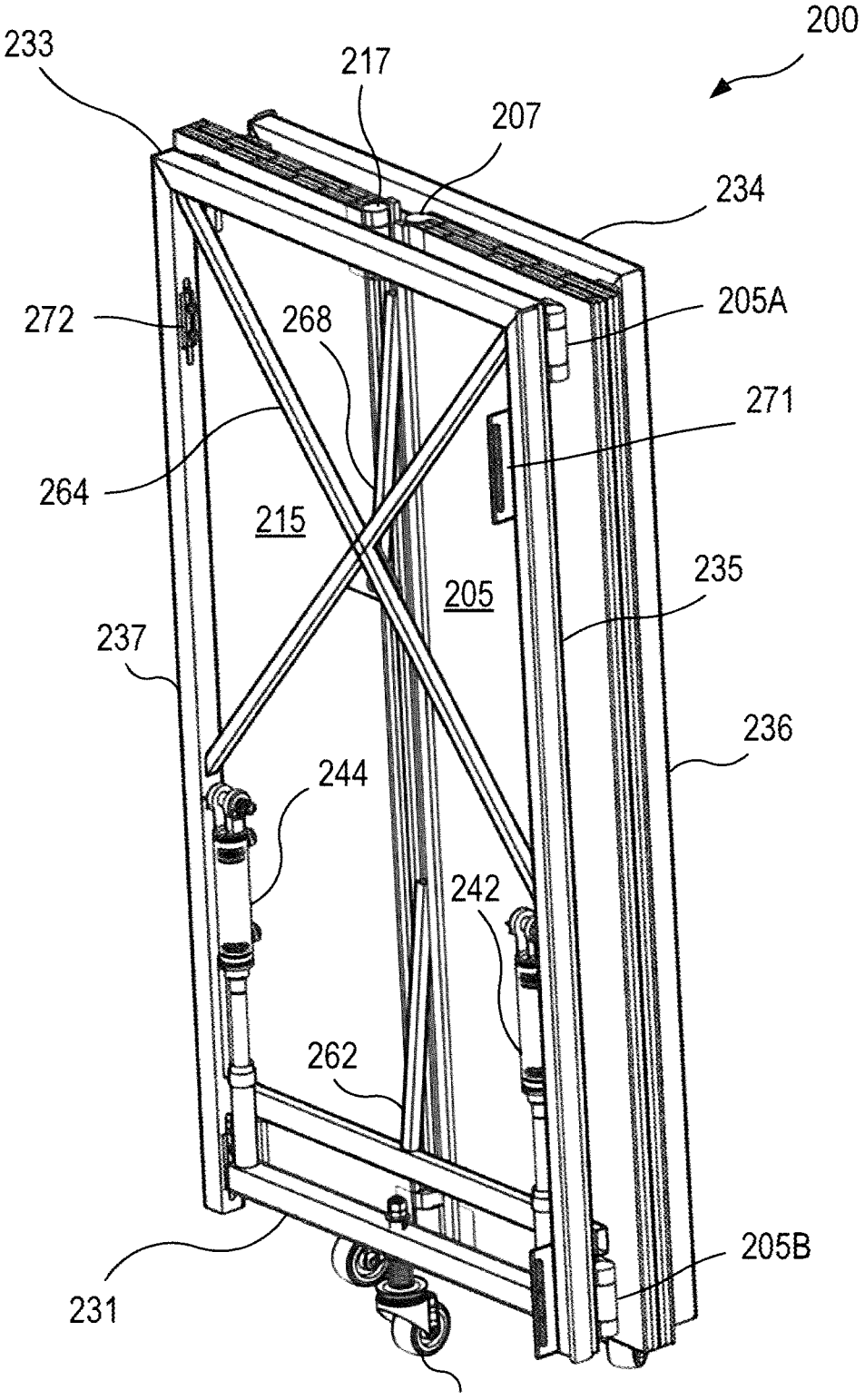
FIGS. 3A and 3B depict aspects of an exemplary Modular Protective System-Ready Armor Protection for Instant Deployment (MPS-RAPID) system, according to certain embodiments of the invention.

FIG. 3A depicts space frame unit 200 in a folded or collapsed configuration, with the wheels in an extended position. As shown here, space frame unit 200 includes first upper horizontal frame member 233, second upper horizontal frame member 234, upper inner central hinge 207, upper outer central hinge 217, first upper hinge 205A, first lower hinge 205B, first inner vertical frame member 235, second inner vertical frame member 236, first outer vertical frame member 237, first inner wall panel assembly 205, first outer wall panel assembly 215, first inner upper slot mechanism 271, first outer upper pin mechanism 272, first lower horizontal frame member 231, first inner suspension mechanism 242, first outer suspension mechanism 244, first wheel 252, first cross support 264, lower locking bar 262, and upper locking bar 268.

Figure 3B:
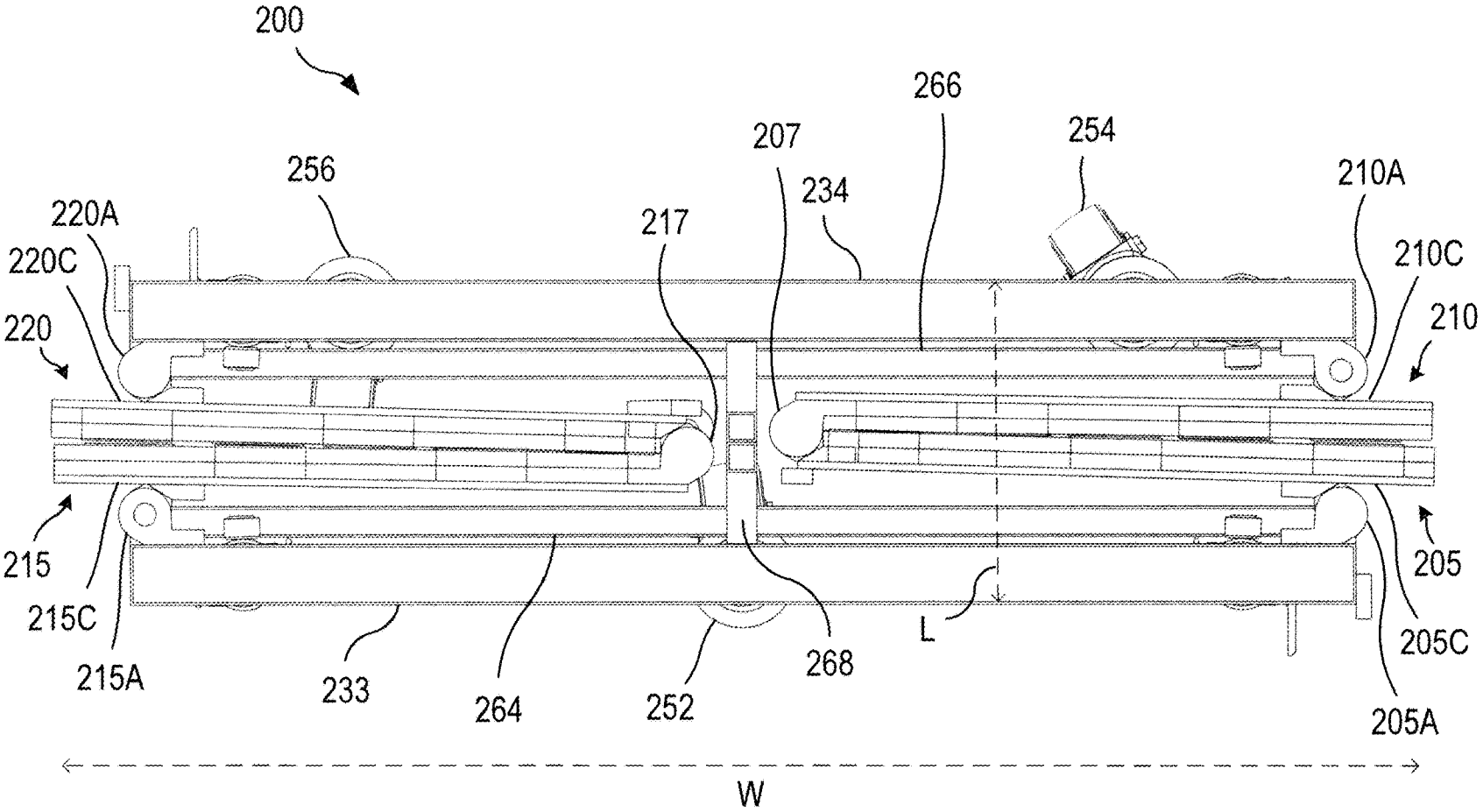

FIG. 3B depicts space frame unit 200 in a folded or collapsed configuration. As shown here, space frame unit 200 includes first upper horizontal frame member 233, second upper horizontal frame member 234, upper inner central hinge 207, upper outer central hinge 217, first upper inner hinge 205A, a second upper inner hinge 210A, first upper outer hinge 215A, second upper outer hinge 220A, first inner wall panel assembly 205, second inner wall panel assembly 210, first outer wall panel assembly 215, second outer wall panel assembly 220, first inner basic armor plate 205C, second inner basic armor plate 210C, first outer basic armor plate 215C, second outer basic armor plate 220C, first wheel 252, second inner wheel 254, second outer wheel 256, upper locking bar 268, first cross support 264, and second cross support 266.

In some cases, a space frame unit in a collapsed or folded configuration can have a width W of 44 inches and a length L of 11 inches.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A ready armor modular protective system for rapid deployment, the system comprising:

a first space frame unit having a first inner wall panel assembly, a second inner wall panel assembly, a first outer wall panel assembly, a second outer wall panel assembly, a first lower horizontal frame member, a second lower horizontal frame member, a first upper horizontal frame member, a second upper horizontal frame member, an upper locking bar, a lower locking bar, a first cross support, a second cross support, a first inner suspension mechanism, a second inner suspension mechanism, a first outer suspension mechanism, a second outer suspension mechanism, and a vertically adjustable coupling mechanism; and a second space frame unit having a first inner wall panel assembly, a second inner wall panel assembly, a first outer wall panel assembly, a second outer wall panel assembly, a first lower horizontal frame member, a second lower horizontal frame member, a first upper horizontal frame member, a second upper horizontal frame member, an upper locking bar, a lower locking bar, a first cross support, a second cross support, a first inner suspension mechanism, a second inner suspension mechanism, a first outer suspension mechanism, a second outer suspension mechanism, and a vertically adjustable coupling mechanism, wherein the vertically adjustable coupling mechanism of the first space frame unit includes an upper pin connecting mechanism, a lower pin connecting mechanism, an upper slot connecting mechanism, and a lower slot connecting mechanism, wherein the vertically adjustable coupling mechanism of the second space frame unit includes an upper pin connecting mechanism, a lower pin connecting mechanism, an upper slot connecting mechanism, and a lower slot connecting mechanism, and wherein the upper pin connecting mechanism of the first space frame unit is in vertically adjustable engagement with the upper slot connecting mechanism of the second space frame unit, the lower pin connecting mechanism of the first space frame unit is in vertically adjustable engagement with the lower slot connecting mechanism of the second space frame unit, the upper slot connecting mechanism of the first space frame unit is in vertically adjustable engagement with the upper pin connecting mechanism of the second space frame unit, and the lower slot connecting mechanism of the first space frame unit is in vertically adjustable engagement with the lower pin connecting mechanism of the second space frame unit.

2. The system according to claim 1, wherein the first space frame unit is convertible between an open configuration and a closed configuration, wherein the upper locking bar of the first space frame unit is lockable to maintain a fixed distance between the first cross support and the second cross support of the first space frame unit, wherein the lower locking bar of the first space frame unit is lockable to maintain a fixed distance between the first lower horizontal frame member and the second lower horizontal frame member of the first space frame unit, wherein the upper locking bar of the second space frame unit is lockable to maintain a fixed distance between the first cross support and the second cross support of the second space frame unit, and wherein the lower locking bar of the first space frame unit is lockable to maintain a fixed distance between the first lower horizontal frame member and the second lower horizontal frame member of the second space frame unit.

3. The system according to claim 1, wherein the first inner suspension member and the second inner suspension member of the first space frame unit operate to allow the first lower horizontal frame member to move vertically relative to the first inner wall panel assembly and the first outer wall panel assembly, and wherein the second inner suspension member and the second outer suspension member of the first space frame unit operate to allow the second lower horizontal frame member to move vertically relative to the second inner wall panel assembly and the second outer wall panel assembly.

4. The system according to claim 1, the first space frame unit further comprises a first wheel coupled with the first lower horizontal frame member, a second inner wheel coupled with the second lower horizontal frame member, and a second outer wheel coupled with the second lower horizontal frame member.

5. The system according to claim 1, wherein the first inner wall panel assembly of the first space frame unit comprises a basic armor plate having an upper flange and a lower flange, the second inner wall panel assembly of the first space frame unit comprises a basic armor plate having an upper flange and a lower flange, the first outer wall panel assembly of the first space frame unit comprises a basic armor plate having an upper flange and a lower flange, and the second outer wall panel assembly of the first space frame unit comprises a basic armor plate having an upper flange and a lower flange.

6. The system according to claim 1, further comprising a first inner supplementary armor plate and a first outer supplementary armor plate engaged by an upper flange and a lower flange of a basic armor plate of the first inner wall panel assembly, a second inner supplementary armor plate and a second outer supplementary armor plate engaged by an upper flange and a lower flange of a basic armor plate of the second inner wall panel assembly, a first inner supplementary armor plate and a first outer supplementary armor plate engaged by an upper flange and a lower flange of a basic armor plate of the first outer wall panel assembly, and a first inner supplementary armor plate and a first outer supplementary armor plate engaged by an upper flange and a lower flange of a basic armor plate of the second outer wall panel assembly.

7. A ready armor modular protective system for rapid deployment, the system comprising:

a first space frame unit having a first inner wall panel assembly, a second inner wall panel assembly, a first outer wall panel assembly, a second outer wall panel assembly, a first lower horizontal frame member, a second lower horizontal frame member, a first upper horizontal frame member, a second upper horizontal frame member, an upper locking bar, a lower locking bar, a first cross support, a second cross support, a first inner suspension mechanism, a second inner suspension mechanism, a first outer suspension mechanism, a second outer suspension mechanism, an upper inner central hinge, a lower inner central hinge, an upper outer central hinge, a lower outer central hinge, and a vertically adjustable coupling mechanism; and a second space frame unit having a first inner wall panel assembly, a second inner wall panel assembly, a first outer wall panel assembly, a second outer wall panel assembly, a first lower horizontal frame member, a second lower horizontal frame member, a first upper horizontal frame member, a second upper horizontal frame member, an upper locking bar, a lower locking bar, a first cross support, a second cross support, a first inner suspension mechanism, a second inner suspension mechanism, a first outer suspension mechanism, a second outer suspension mechanism, an upper inner central hinge, a lower inner central hinge, an upper outer central hinge, a lower outer central hinge, a first upper inner hinge, a first lower inner hinge, a second upper inner hinge, a second lower inner hinge, a first upper outer hinge, a first lower outer hinge, a first upper outer hinge, a first lower outer hinge, and a vertically adjustable coupling mechanism, wherein the first inner wall panel assembly is coupled with the second inner wall panel assembly via the upper inner central hinge and the lower inner central hinge and the first outer wall panel assembly is coupled with the second outer wall panel assembly via the upper outer central hinge and the lower outer central hinge, wherein the vertically adjustable coupling mechanism of the first space frame unit includes an upper pin connecting mechanism, a lower pin connecting mechanism, an upper slot connecting mechanism, and a lower slot connecting mechanism, wherein the vertically adjustable coupling mechanism of the second space frame unit includes an upper pin connecting mechanism, a lower pin connecting mechanism, an upper slot connecting mechanism, and a lower slot connecting mechanism, and wherein the upper pin connecting mechanism of the first space frame unit is in vertically adjustable engagement with the upper slot connecting mechanism of the second space frame unit, the lower pin connecting mechanism of the first space frame unit is in vertically adjustable engagement with the lower slot connecting mechanism of the second space frame unit, the upper slot connecting mechanism of the first space frame unit is in vertically adjustable engagement with the upper pin connecting mechanism of the second space frame unit, and the lower slot connecting mechanism of the first space frame unit is in vertically adjustable engagement with the lower pin connecting mechanism of the second space frame unit.

8. The system according to claim 7, wherein the first space frame unit is convertible between an open configuration and a closed configuration, wherein the upper locking bar of the first space frame unit is lockable to maintain a fixed distance between the first cross support and the second cross support of the first space frame unit, wherein the lower locking bar of the first space frame unit is lockable to maintain a fixed distance between the first lower horizontal frame member and the second lower horizontal frame member of the first space frame unit, wherein the upper locking bar of the second space frame unit is lockable to maintain a fixed distance between the first cross support and the second cross support of the second space frame unit, and wherein the lower locking bar of the first space frame unit is lockable to maintain a fixed distance between the first lower horizontal frame member and the second lower horizontal frame member of the second space frame unit.

9. The system according to claim 7, wherein the first inner suspension member and the second inner suspension member of the first space frame unit operate to allow the first lower horizontal frame member to move vertically relative to the first inner wall panel assembly and the first outer wall panel assembly, and wherein the second inner suspension member and the second outer suspension member of the first space frame unit operate to allow the second lower horizontal frame member to move vertically relative to the second inner wall panel assembly and the second outer wall panel assembly.

10. The system according to claim 7, the first space frame unit further comprises a first wheel coupled with the first lower horizontal frame member, a second inner wheel coupled with the second lower horizontal frame member, and a second outer wheel coupled with the second lower horizontal frame member.

11. The system according to claim 7, wherein the first inner wall panel assembly of the first space frame unit comprises a basic armor plate having an upper flange and a lower flange, the second inner wall panel assembly of the first space frame unit comprises a basic armor plate having an upper flange and a lower flange, the first outer wall panel assembly of the first space frame unit comprises a basic armor plate having an upper flange and a lower flange, and the second outer wall panel assembly of the first space frame unit comprises a basic armor plate having an upper flange and a lower flange.

12. The system according to claim 11, further comprising a first inner supplementary armor plate and a first outer supplementary armor plate engaged by an upper flange and a lower flange of a basic armor plate of the first inner wall panel assembly, a second inner supplementary armor plate and a second outer supplementary armor plate engaged by an upper flange and a lower flange of a basic armor plate of the second inner wall panel assembly, a first inner supplementary armor plate and a first outer supplementary armor plate engaged by an upper flange and a lower flange of a basic armor plate of the first outer wall panel assembly, and a first inner supplementary armor plate and a first outer supplementary armor plate engaged by an upper flange and a lower flange of a basic armor plate of the second outer wall panel assembly.

13. The system according to claim 7, further comprising a first inner supplementary armor plate and a first outer supplementary armor plate engaged by an upper flange and a lower flange of a basic armor plate of the first inner wall panel assembly, a second inner supplementary armor plate and a second outer supplementary armor plate engaged by an upper flange and a lower flange of a basic armor plate of the second inner wall panel assembly, a first inner supplementary armor plate and a first outer supplementary armor plate engaged by an upper flange and a lower flange of a basic armor plate of the first outer wall panel assembly, and a first inner supplementary armor plate and a first outer supplementary armor plate engaged by an upper flange and a lower flange of a basic armor plate of the second outer wall panel assembly.

14. A ready armor modular protective system for rapid deployment, the system comprising:

a first space frame unit having a first inner wall panel assembly, a second inner wall panel assembly, a first outer wall panel assembly, a second outer wall panel assembly, a first lower horizontal frame member, a second lower horizontal frame member, a first upper horizontal frame member, a second upper horizontal frame member, an upper locking bar, a lower locking bar, a first cross support, a second cross support, a first inner suspension mechanism, a second inner suspension mechanism, a first outer suspension mechanism, a second outer suspension mechanism, a first inner vertical frame member, a second inner vertical frame member, a first outer vertical frame member, a second outer vertical frame member, a first upper inner hinge, a first lower inner hinge, a second upper inner hinge, a second lower inner hinge, a first upper outer hinge, a first lower outer hinge, a first upper outer hinge, a first lower outer hinge, and a vertically adjustable coupling mechanism; and a second space frame unit having a first inner wall panel assembly, a second inner wall panel assembly, a first outer wall panel assembly, a second outer wall panel assembly, a first lower horizontal frame member, a second lower horizontal frame member, a first upper horizontal frame member, a second upper horizontal frame member, an upper locking bar, a lower locking bar, a first cross support, a second cross support, a first inner suspension mechanism, a second inner suspension mechanism, a first outer suspension mechanism, a second outer suspension mechanism, an upper inner central hinge, a lower inner central hinge, an upper outer central hinge, a lower outer central hinge, a first upper inner hinge, a first lower inner hinge, a second upper inner hinge, a second lower inner hinge, a first upper outer hinge, a first lower outer hinge, a first upper outer hinge, a first lower outer hinge, and a vertically adjustable coupling mechanism, wherein the vertically adjustable coupling mechanism of the first space frame unit includes an upper pin connecting mechanism, a lower pin connecting mechanism, an upper slot connecting mechanism, and a lower slot connecting mechanism, wherein the vertically adjustable coupling mechanism of the second space frame unit includes an upper pin connecting mechanism, a lower pin connecting mechanism, an upper slot connecting mechanism, and a lower slot connecting mechanism, wherein the upper pin connecting mechanism of the first space frame unit is in vertically adjustable engagement with the upper slot connecting mechanism of the second space frame unit, the lower pin connecting mechanism of the first space frame unit is in vertically adjustable engagement with the lower slot connecting mechanism of the second space frame unit, the upper slot connecting mechanism of the first space frame unit is in vertically adjustable engagement with the upper pin connecting mechanism of the second space frame unit, and the lower slot connecting mechanism of the first space frame unit is in vertically adjustable engagement with the lower pin connecting mechanism of the second space frame unit.

15. The system according to claim 14, wherein the first inner wall panel assembly is coupled with the first inner vertical frame member via the first upper inner hinge and the first lower inner hinge, the second inner wall panel assembly is coupled with the second inner vertical frame member via the second upper inner hinge and the second lower inner hinge, the first outer wall panel assembly is coupled with the first outer vertical frame member via the first upper outer hinge and the first lower outer hinge, and the second outer wall panel assembly is coupled with the second outer vertical frame member via the second upper outer hinge and the second lower outer hinge.

16. The system according to claim 14, further comprising an upper inner central hinge, a lower inner central hinge, an upper outer central hinge, and a lower outer central hinge, wherein the first inner wall panel assembly is coupled with the second inner wall panel assembly via the upper inner central hinge and the lower inner central hinge and the first outer wall panel assembly is coupled with the second outer wall panel assembly via the upper outer central hinge and the lower outer central hinge.

17. The system according to claim 14, wherein the first space frame unit is convertible between an open configuration and a closed configuration, wherein the upper locking bar of the first space frame unit is lockable to maintain a fixed distance between the first cross support and the second cross support of the first space frame unit, wherein the lower locking bar of the first space frame unit is lockable to maintain a fixed distance between the first lower horizontal frame member and the second lower horizontal frame member of the first space frame unit, wherein the upper locking bar of the second space frame unit is lockable to maintain a fixed distance between the first cross support and the second cross support of the second space frame unit, and wherein the lower locking bar of the first space frame unit is lockable to maintain a fixed distance between the first lower horizontal frame member and the second lower horizontal frame member of the second space frame unit.

18. The system according to claim 14, wherein the first inner suspension member and the second inner suspension member of the first space frame unit operate to allow the first lower horizontal frame member to move vertically relative to the first inner wall panel assembly and the first outer wall panel assembly, and wherein the second inner suspension member and the second outer suspension member of the first space frame unit operate to allow the second lower horizontal frame member to move vertically relative to the second inner wall panel assembly and the second outer wall panel assembly.

19. The system according to claim 14, the first space frame unit further comprises a first wheel coupled with the first lower horizontal frame member, a second inner wheel coupled with the second lower horizontal frame member, and a second outer wheel coupled with the second lower horizontal frame member.

20. The system according to claim 14, wherein the first inner wall panel assembly of the first space frame unit comprises a basic armor plate having an upper flange and a lower flange, the second inner wall panel assembly of the first space frame unit comprises a basic armor plate having an upper flange and a lower flange, the first outer wall panel assembly of the first space frame unit comprises a basic armor plate having an upper flange and a lower flange, and the second outer wall panel assembly of the first space frame unit comprises a basic armor plate having an upper flange and a lower flange.

* * * * *